United States Patent [19]

Nomura et al.

[11] 3,971,205

[45] July 27, 1976

[54] ALL ELECTRONIC-TYPE TIMEPIECE

[75] Inventors: Yasushi Nomura, Tokorozawa; Shigeru Morokawa, Higashiyamato, both of Japan

[73] Assignee: Citizen Watch Co., Ltd., Tokyo, Japan

[22] Filed: Sept. 5, 1974

[21] Appl. No.: 503,458

[30] Foreign Application Priority Data

Sept. 6, 1973 Japan ..... 48-100696
Nov. 20, 1973 Japan ..... 48-130516

[52] U.S. Cl. ..... 58/50 R; 58/4 A; 58/23 R

[51] Int. Cl.² ..... G04B 19/30; G04B 19/24; G04C 3/00

[58] Field of Search ..... 58/4 A, 23 BA, 50 R, 58/152 H; 340/249

[56] References Cited

UNITED STATES PATENTS

| | | | |
|---|---|---|---|
| 3,668,861 | 6/1972 | Mitsui | 58/50 R |
| 3,678,499 | 7/1972 | McCarty | 340/336 |
| 3,839,856 | 10/1974 | Dargent | 58/4 A |

*Primary Examiner*—Edith Simmons Jackmon
*Attorney, Agent, or Firm*—Sherman & Shalloway

[57] ABSTRACT

An all electronic type timepiece is disclosed which comprises a customary or usual display for displaying time, a calendar, a.m., p.m., colon and other functions. An additional display element is provided separately from the customary display or alternatively is constructed as a part thereof for displaying the operating condition of a time counter circuit even when the customary display is extinguished.

5 Claims, 15 Drawing Figures

ALL ELECTRONIC-TYPE TIMEPIECE

BACKGROUND OF THE INVENTION

This invention relates to an all electronic timepiece which can control driving of display parts of a display for the purpose of saving electric power consumed by the timepiece.

PRIOR ART AND TECHNICAL CONSIDERATIONS

A conventional timepiece which makes use of a battery as an electric source for a time counter circuit has the disadvantage that the battery after a long use must be replaced by a new battery. This replacement of batteries results in troublesome handling and excessive cost. In order to obviate the disadvantage encountered with the replacement of the battery, it has, heretofore, been proposed to use a secondary battery and charge it with the aid of a solar battery or exterior charging device. However, a problem remains as to how to save the consumed electric power and to lengthen the life of a battery of a given capacity.

In order to solve this problem, in portable timepieces or the like it has been proposed to drive or power a display only when the timepiece is used and to extinguish the display when the timepiece is not used so as to decrease the electric power consumed by the decoders, display driving circuits and the display itself. Such conventional portable timepieces have the disadvantage that when the display part is extinguished all of the displays become extinguished so that it is impossible to discern whether or not the time counter circuit is operating.

An all electric portable timepiece which uses a photodiode has been manufactured and sold commercially. In such a timepiece, it has been the common practice to extinguish all of the displays of the display part not used because the photodiode consumes considerable electric power. When the life of a battery after a long use ends, an exteriorly operated member must be operated to ignite all of the display bodies for the purpose of investigating whether or not the time counter circuit is in operating condition. In addition, the unknown operating condition of the time counter circuit causes a user to feel uneasy with respect to the function and precision of the timepiece.

In addition to providing circuitry for ignition and extinction of an additional display body, a conventional all electronic timepiece which can perform a number of functions must be provided with corresponding number of display portions for the purpose of displaying respective operating conditions of the time counter circuit due to these added display portions. As a result, the timepiece must increase its surface area in order to arrange these added display bodies thereon and hence consumes additional electric power. In order to obviate this disadvantage, it is necessary to decrease the number of functions performed by the timepiece.

OBJECTS OF THE INVENTION

An object of the invention is to provide an all electronic timepiece which obviates the above mentioned disadvantages of the prior art timepieces to save on the amount of power consumed.

Another object of the invention is to provide an all electronic timepiece which can display the operating condition of the time counter circuit even when an exteriorly operating member is operated to extinguish the display of time, calendar and the like.

A further object of the invention is to provide an all electronic timepiece which is provided with an additional electro-optical display capable of displaying the operating condition of the time counter circuit even when the exteriorly operating member is operated to extinguish the display of time, calendar and the like.

Still a further object of the invention is to provide an all electronic timepiece which makes use of a part of the display of time, calendar and the like to display the operating condition of the time counter circuit even when the exteriorly operating member is operated to extinguish the display of time, calendar and the like.

BRIEF DESCRIPTION OF THE DRAWINGS

The invention will now be described in greater detail with reference to the accompanying drawings, wherein.

DETAILED DESCRIPTION OF THE INVENTION

Figure 1:
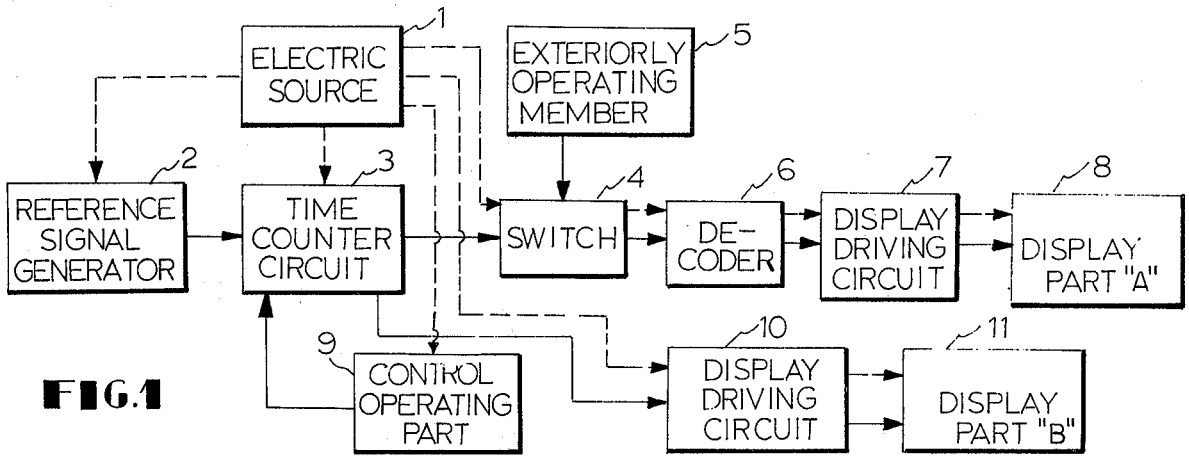
FIG. 1 is a block diagram illustrating one embodiment of an all electronic liquid crystal display portable timepiece according to the invention.

FIG. 1 shows an embodiment of the all electronic type liquid crystal display portable timepiece according to the invention comprising an electric source 1, a reference high frequency signal generator 2 including a crystal oscillator or tuning fork oscillator, a time counter circuit 3 for dividing a frequency of the reference high frequency signal and counting the divided frequency as a time signal, a switch 4, an exteriorly operated member 5, a decoder 6, a customary display part 8 for displaying time, calendar and the like, a display driving circuit 7 for driving the display part 8, an additional display part 11 for displaying an operating condition of the time counter circuit 3, a display driving circuit 10 for driving the additional display part 11, and a control operating part 9. If a user wishes to look at his timepiece, the exteriorly operated member 5 is operated to close the switch 4 and ignite or energize the customary display part 8.

The switch 4 may be constructed such that it is normally closed so as to always ignite the customary display part 8.

If the timepiece is not used, the exteriorly operated member 5 is operated so as to open the switch 4. As a result, the decoder 6 and display driving circuit 7 become inoperative and the customary display part 8 extinguishes.

The additional display part 11 contrary to the customary display part 8 is under the operating condition that is continuously or discontinuously ignited irrespective of the condition of the switch 4. When the customary display part 8 is extinguished, the additional display part 11 for displaying only the operating condition of the time counter circuit 3 remains ignited. As a result, the additional display part 11 is capable of not only displaying the operating condition of the time counter circuit 3, but also displaying the life of a battery used as the electric source 1.

Figure 2:
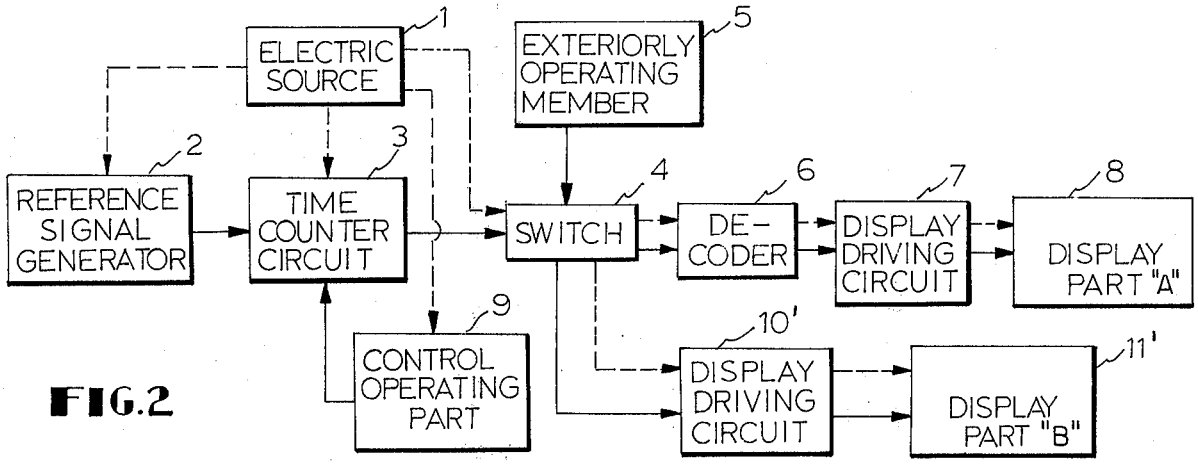
FIG. 2 is a block diagram illustrating another embodiment of an all electronic liquid crystal display portable timepiece according to the invention.

FIG. 2 shows another embodiment of the overall electronic type liquid crystal display portable timepiece according to the invention, wherein like numerals refer to like parts shown in FIG. 1.

In the timepiece shown in FIG. 2, if the exteriorly operated member 5 is operated to close the switch 4, the decoder 6 and display driving circuit 7 become energized in succession to ignite the customary display part 8 on the one hand, while a display driving circuit 10' becomes inoperative to extinguish an additional display part 11' on the other hand.

Conversely, if the decoder 6 and display driving circuit 7 become inoperative to extinguish the customary display part 8, the display driving circuit 10' becomes operated to ignite the additional display part 11'.

Figure 3A:
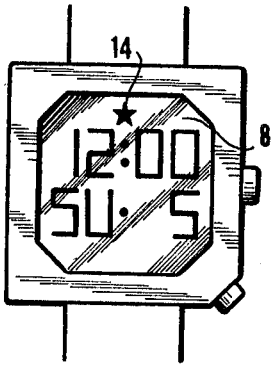
FIG. 3*a* is a front elevation of one embodiment of the all electronic liquid crystal display portable timepiece shown in FIG. 1 showing a customary display part including displays for time, calendar and the like and an additional display part, all of the display parts being ignited.

In FIG. 3 is shown an example of a display displayed by the all electronic liquid crystal display timepiece shown in FIG. 1. FIG. 3*a* shows the customary display part 8 under ignited condition displaying 12 hour 00 minute, Sunday and 5th day. The display member 8 is provided at its upper center portion with an additional display 14 shown by a star. The additional display 14 corresponds to the display part 11 shown in FIG. 11 and may normally be made under flashing condition.

Figure 3B:
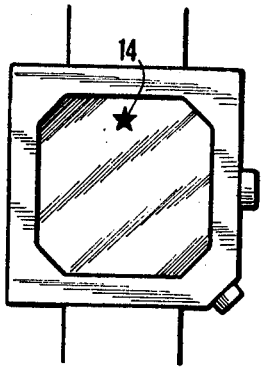
FIG. 3*b* shows the timepiece shown in FIG. 3*a*, the customary display part being extinguished and the additional display part only being ignited.

FIG. 3*b* shows the customary display part 8 under its extinguished condition in which the additional display 14 only is ignited to show that the time counter circuit 3 is under its operative condition. In this case, not only the customary display part 8 is extinguished, but also the decoder 6 and display driving circuit 7 are not operated, and as a result, the consumed electric power is extremely small.

Figure 4A:
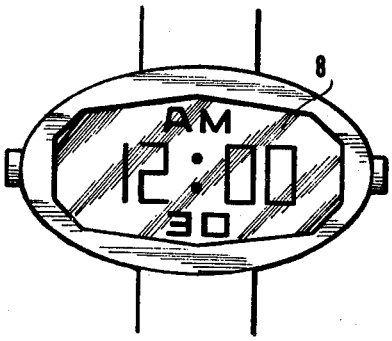
FIG. 4*a* is a front elevation of another embodiment of the all electronic liquid crystal display portable timepiece shown in FIG. 2 with the customary display part ignited.
Figure 4B:
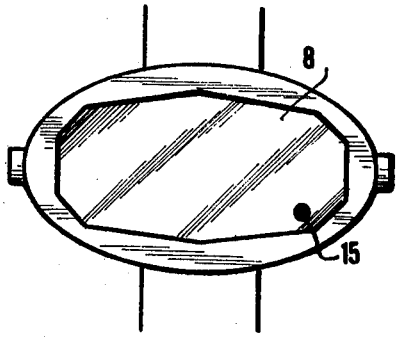
FIG. 4*b* shows the timepiece shown in FIG. 4a with the customary display part extinguished and the additional display part ignited.

FIG. 4 shows a practical display example of the overall electronic liquid crystal portable timepiece shown in FIG. 2. FIG. 4*a* shows the customary display part 8 which is ignited to display 12 hours 00 minutes 30 seconds A.M.

Figure 5A:
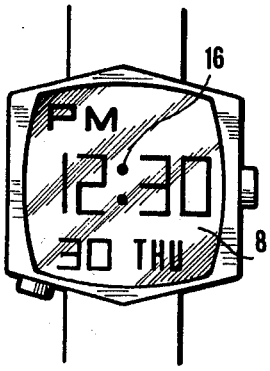
FIG. 5*a* is a front elevation of another embodiment of the all electronic liquid crystal display portable timepiece shown in FIG. 1 with the customary display part inclusive of a colon ignited.

FIG. 5 shows another embodiment of the overall electronic type liquid crystal display timepiece according to the invention shown in FIG. 1. The display part 8A is under the operating condition and, as shown in FIG. 5*a* displays 30th day, Thursday, 12 hours 30 minutes, P.M. In the present embodiment, seconds are displayed by flashing colon-shaped display body 16.

Figure 5B:
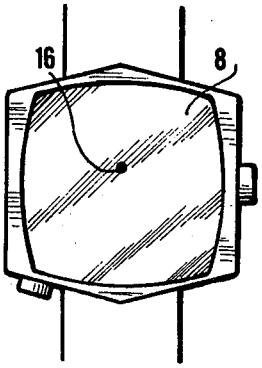
FIG. 5*b* shows the timepiece shown in FIG. 5a with the customary display part extinguished except upper point of the colon which is used as the additional display part.

FIG. 5*b* shows the customary display part 8 which is extinguished. In this case, a point additional display body 16 constituted by the upper point of the colon-shaped customary display body 16 serves as an additional display body for displaying the operative condition of the time counter circuit 3. This display body 16 corresponds to the display part 11 shown in FIG. 1. Even when the customary display bodies become extinguished, the point additional display body 16 continues its flashing condition.

In this case also, the decoder 6 and display driving circuit 7 for delivering a signal to the customary display part 8 are not operated.

In the case of a time measuring instrument such as a time watch, if numerical values displayed by the display part can be ascertained at the beginning and end of the time counting operation, it is sufficient to ascertain whether or not the normal counting is effected. The invention, therefore, provides the following time measuring instrument as set forth in FIG. 6.

Figure 6:
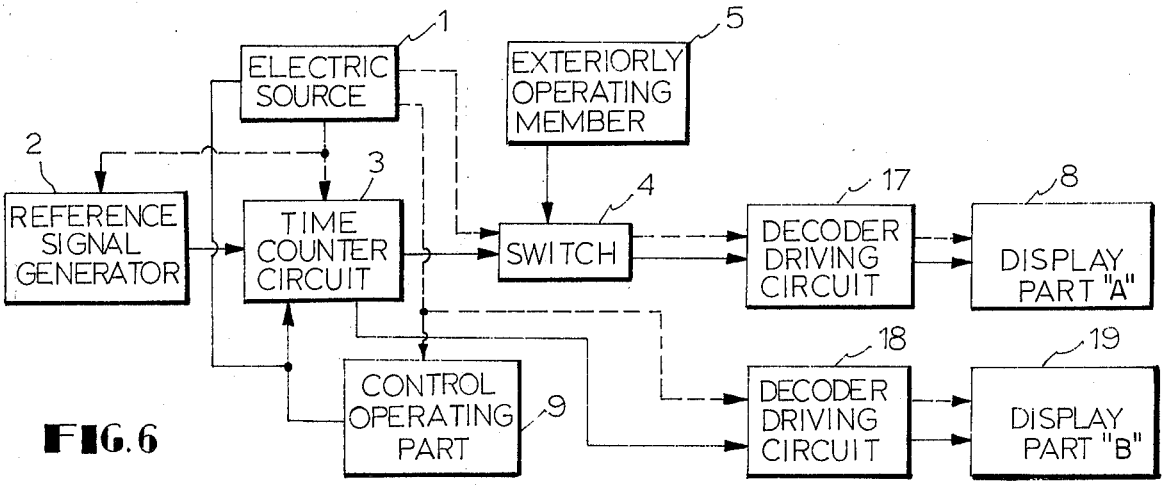
FIG. 6 is a block diagram illustrating one embodiment of the all electronic type time measuring instrument according to the invention.

FIG. 6 shows one embodiment of the all electronic type time measuring instrument according to the invention, wherein similar numerals refer to similar parts shown in FIG. 1. In the present embodiment, the customary display part 8 and an additional display part 19 are driven by decoder-driving circuits 17 and 18, respectively. The control operating part 9 mainly serves to start and stop the time counter circuit 3.

FIG. 7 shows an example of a display operated by the all electronic time measuring instrument shown in FIG. 6.

Figure 7A:
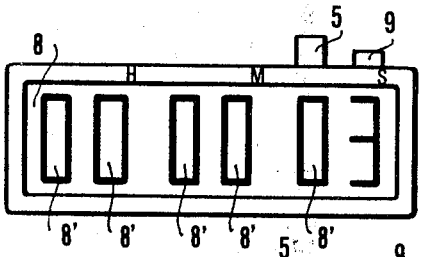
FIG. 7*a* is a front elevation of the time measuring instrument shown in FIG. 6 with the customary display part ignited under customary time measuring condition.

FIG. 7a shows the customary display part 8 provided with five time unit display bodies 8' which display "10 seconds," "minute," "10 minutes," "hour" and "10 hours", respectively. The display part 8 shown in FIG. 7*a* shows these time unit display bodies 8' lasting 3 seconds after starting the time measurement by pushing the control operating part 9 only.

Figure 7B:
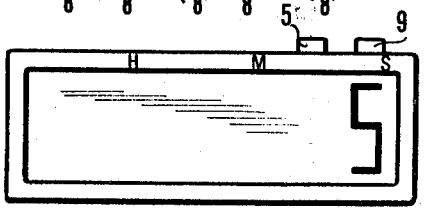
FIG. 7*b* is a front elevation of the time measuring instrument shown in FIG. 7*a* with the customary display part extinguished and the second time unit used as the additional display part ignited.

FIG. 7*b* shows all of the time unit display bodies 8' are extinguished by pushing the exteriorly operated part 9, while the numeral 5 is ignited or lit. The numeral 5 corresponds to the additional display part 19 and displays the time unit of "second." In the present embodiment, the electric power consumed by the decoder driving circuits 17, 18 and all of the customary display part 8 becomes about one-sixth less than that consumed when the circuits 17, 18 and customary display part 8 are energized. In addition, the fact that the time measurement is effected can be ascertained by the "second" time unit display body which is in its flashing condition.

The switch 4 shown in FIG. 6, capable of controlling the customary display part 8, may be interlocked with the control operating part 9 so that if the control operating part 9 is operated to start the time measuring operation all of the display bodies are instantaneously ignited and the time signal and electric source voltage supplied to the decoder driving circuit 17 and the customary display part 8 are interrupted. If the control operating part 9 is operated again to start the time measuring operation, all of the display bodies are ignited. A combination of such modified construction and the time measuring instrument shown in FIG. 6 ensures ignition of all of the display bodies at will during the time measuring operation, and provides an important advantage in certain situations such as, for example, the distance travelled by a vehicle within a predetermined time can be measured.

The display system shown in FIGS. 5 and 7 makes use of a portion of the display part provided for the timepiece such, for example, as existing time, hour colon, AM, PM displays and the like for the purpose of displaying newly added functions and displaying the operating condition of the timepiece caused by such newly added functions. Such a display system permits increasing the number of types of informations to be considered by the total electronic type timepiece in the future. In this case, however, the circuit provided for the timepiece becomes complex and hence the number of conditions to be considered would be increased. Under such circumstances, the display systems shown in FIGS. 5 and 7, which are simple in construction and reliable in operation, are quite important and useful for the all electronic timepieces.

FIG. 8 shows another embodiment of the all electronic type timepiece according to the invention in which the hour, minute display is changed over to a function for effecting temporary alarm, daily alarm and the like. In the present embodiment, use is made of a combination of different displays in accordance with different kinds of alarms.

Figure 8A:
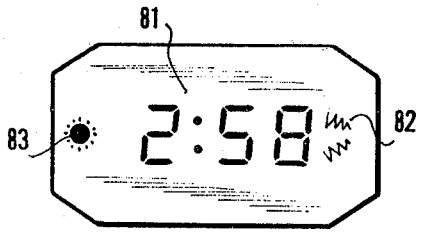
FIGS. 8*a* to 8*c* are front elevations showing various embodiments of the all electronic alarm timepiece according to the invention.

FIG. 8*a* shows a customary display body for giving a temporary alarm in which use is made of a combination of a time display body 81 and an alarm display body 82 shown by an alarm symbol. Reference numeral 83 designates an AM-PM display body shown by a sun symbol. In the present embodiment shown in FIG. 8*a*, an alarm is given at 2 hours 58 minutes PM.

Figure 8B:
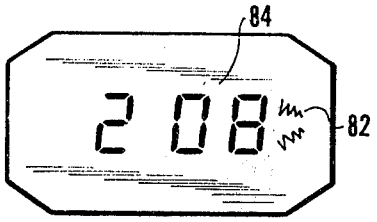

FIG. 8*b* shows a customary time display body 84 showing February 8th on which date an alarm is to be given by the alarm display body 82.

Figure 8C:
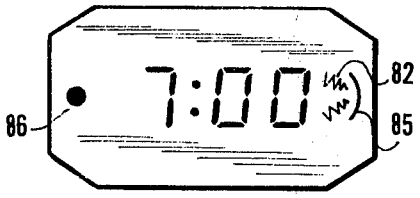

FIG. 8*c* shows another display body 85 arranged adjacent the alarm display body 82 and giving a daily alarm when ignited. In the present embodiment, reference numeral 86 designates an AM-PM display body shown by a dot mark. In the present embodiment, an alarm is given at 7 o'clock every morning when the daily alarm is set at this time.

Figure 8D:
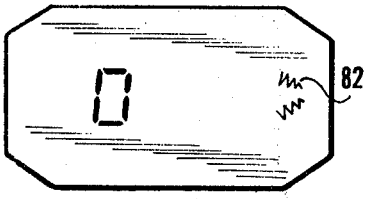
FIG. 8*d* is a front elevation of the timepiece shown in FIGS. 8*a* to 8*c* in which a part of the alarm time display is ignited when the other parts are extinguished to display the operating condition of the time counter circuit.

FIG. 8*d* shows a display body which is displayed when the above mentioned alarm ceases. In the present embodiment, a combination of a display "0" and the alarm display body 82 is capable of displaying the condition indicating that the alarm set is released.

In the present embodiment, a part of the time display 81 shown in FIG. 8*a* is ignited and the remaining displays are extinguished so as to display that the time counter circuit is operative. Thus, the present embodiment can display the condition that the alarm set is released without increasing the number of display bodies and provides the important advantage that the display part is simple in construction, and that the consumed electric power is minimized.

In the present embodiment, only the hour display body of the time display part 81 shown in FIG. 8*a* is made 0. Alternatively, the 10 minute display body or the minute display body may be made 0. In addition, 0 may be replaced by any of the numerals 1 to 9. The use of such measures ensures various kinds of displays for displaying the interior operating condition of the timepiece circuit. In this case, the timepiece may be provided on its rear side or on its proper accessories with indications by which the user can recognize correspondence between these displays and the interior operating conditions of the timepiece.

In the above described embodiments, light receiving elements such as a liquid crystal or the like have been used as photoelectric display devices. As light receiving elements, use may also be made of light emitting elements such as electroluminescent elements, photodiodes or the like.

As stated hereinbefore, the all electronic portable timepiece is capable of displaying the operating condition of the time counter circuit even when the display bodies for time display, calendar display and the like are extinguished, and provides the important advantage that the user can rely upon the function and precision of the timepiece, and that any troublesome operation confirming the operating condition of the timepiece becomes unnecessary.

The total electronic timepiece according to the invention which makes use of a part of the display body so as to display the operating condition of the timepiece is unique in the timepiece field and is useful not only as a portable watch but also as a wall clock and a table clock which can easily discern a plurality of conditions with minimal consumption of electric power.

What is claimed is:

1. A time measuring device which is completely electronic comprising a reference signal generating source for producing pulses, a time counter cicuit for counting said pulses, a decoder driving circuit for decoding the output of said time counter circuit, a control operating member for initiating operation of said counter circuit, a first electro-optical display part connected to said decoder for displaying measured time, a switch controllable from said time counter circuit and independent of the operating condition of said first electro-optical display, a second electro-optical display for displaying the operating condition of said time counter circuit, and an additional electro-optical display circuit including a display driving circuit for driving said electro-optical display, wherein when measuring time, operation of said switch causes at least a part of said first electro-optical display to extinguish and simultaneously causes said additional electro-optical display circuit to operate so that said second electro-optical display is driven and thereby indicates the operating condition of said time counter circuit.

2. The time measuring device of claim 1 wherein said second electro-optical display is an exclusive symbol display element in the form of a pattern or character.

3. The time measuring device of claim 1 wherein said second electro-optical display displays the operating condition of said time counter circuit.

4. The time measuring device of claim 1 wherein said switch is controlled by said control operating member.

5. The time measuring device of claim 1, wherein the second electro-optical is a portion of said first electronic display.

* * * * *